US010907358B1

(12) United States Patent
McDow, Jr. et al.

(10) Patent No.: US 10,907,358 B1
(45) Date of Patent: Feb. 2, 2021

(54) ROOF VENT WITH SECURE ATTACHMENT MECHANISMS

(71) Applicant: Golden Rule Fasteners, Inc., Tallassee, AL (US)

(72) Inventors: William Archie McDow, Jr., Tallassee, AL (US); David Campbell McDow, Tallassee, AL (US)

( * ) Notice: Subject to any disclaimer, the term of this patent is extended or adjusted under 35 U.S.C. 154(b) by 0 days.

(21) Appl. No.: 16/676,897

(22) Filed: Nov. 7, 2019

(51) Int. Cl.
*E04D 13/17* (2006.01)
*F24F 7/02* (2006.01)
*F24F 7/04* (2006.01)

(52) U.S. Cl.
CPC ..... *E04D 13/17* (2013.01); *E04D 13/174* (2013.01); *E04D 13/178* (2013.01); *F24F 7/02* (2013.01); *F24F 7/04* (2013.01)

(58) Field of Classification Search
CPC ..... E04D 13/17; E04D 13/174; E04D 13/178; F24F 7/02; F24F 7/04
USPC ..... 52/199; 454/250, 275
See application file for complete search history.

(56) References Cited

U.S. PATENT DOCUMENTS 226,625 A * 4/1880 Pardessus ..... E04D 13/0325 454/199
288,535 A * 11/1883 Williams ..... E04D 13/0325 454/199
1,080,137 A * 12/1913 Carter ..... E04D 13/174 52/199
2,806,419 A * 9/1957 Artis ..... F24F 7/02 454/199
2,985,091 A * 5/1961 Hatcher ..... E04D 13/1471 454/47
3,302,551 A * 2/1967 Belle ..... F24F 7/025 454/354
3,783,767 A * 1/1974 Stalker ..... F24F 7/02 454/368

(Continued)

FOREIGN PATENT DOCUMENTS

GB 1082668 A * 9/1967 ..... E04D 13/17
GB 2052044 A * 1/1981 ..... F24F 7/02
WO WO-2019208899 A1 * 10/2019 ..... F24F 7/04

*Primary Examiner* — Adriana Figueroa
(74) *Attorney, Agent, or Firm* — Snell & Wilmer L.L.P.

(57) ABSTRACT

Vents are disclosed for covering openings on roofs. The disclosed vents cover openings on metal roofs and prevent moisture and objects from entering the opening while allowing air to pass therethrough. The vents disclosed herein also prevent moisture from entering the building through openings that can be created when the vents are attached to a roof. The vents include a cap, a collar, and a flashing configured to contact the roof. The vents can also include a screen placed between the cap and the collar. The collar can have arms formed on an upper portion thereof to facilitate connection of the collar to the cap. Feet can be formed on a bottom portion of the collar. Once the vent is fully assembled, the feet can be positioned underneath the flashing and can be the main connection point of the vent to a roof. Due to the design of this assembly, fasteners pass through the feet providing a sound and secure attachment to the roof. The feet are then covered from moisture, rain, and/or snow by a flashing, and the flashing is then secured by screws or other fasteners passing through the reinforcement material and through the flashing itself which provides a weatherproof seal.

20 Claims, 6 Drawing Sheets

(56) References Cited

U.S. PATENT DOCUMENTS

| | | | | | |
|---|---|---|---|---|---|
| 3,934,383 | A * | 1/1976 | Perry | E04D 13/0352 | 52/200 |
| 3,984,947 | A * | 10/1976 | Patry | E04D 13/17 | 52/1 |
| 5,662,522 | A * | 9/1997 | Waltz | E04D 13/17 | 454/359 |
| 5,815,996 | A * | 10/1998 | Granger | F24F 7/02 | 52/202 |
| 6,102,794 | A * | 8/2000 | Cline | F24F 7/02 | 454/368 |
| 7,882,670 | B2 * | 2/2011 | West | E04D 13/1476 | 454/13 |
| 8,205,401 | B2 * | 6/2012 | Ward | F24F 7/02 | 454/367 |
| 9,457,304 | B2 * | 10/2016 | Bourque | F24F 12/006 | |
| 2011/0094165 | A1 * | 4/2011 | McDow, Jr. | E04D 13/1476 | 52/58 |

* cited by examiner

ROOF VENT WITH SECURE ATTACHMENT MECHANISMS

FIELD OF THE INVENTION

This invention relates to vents for covering openings on roofs. More particularly, the invention relates to vents that cover openings on metal roofs, preventing moisture and objects from entering the opening while allowing air to pass therethrough. The vents disclosed herein also prevent moisture from entering the building through openings that can be created when the vents are attached to a roof. The vents include a cap, a collar, and a flashing configured to contact the roof. The vents can also include a screen placed between the cap and the collar. The collar can have arms formed on an upper portion thereof to facilitate connection of the collar to the cap. Feet can be formed on a bottom portion of the collar. Once the vent is fully assembled, the feet can be positioned underneath the flashing and can be the main connection point of the vent to a roof.

BACKGROUND

Vents are often used on roofs, both commercial and residential, to release indoor steam and other gases to the atmosphere. Some examples are vents for agricultural and industrial buildings, bathroom vents, laundry room exhaust vents, and kitchen range vents. These vents may include a cap; a screen to prevent rain, insects, and other pests from entering the vent; and a flashing to interface with the roof. Various materials are used to form such vents, including various plastics, metals, and rubber materials. Securely attaching such vents to a metal roof presents several challenges. For example, the attachment method must be secure enough to withstand wind and other environmental factors. More problematic, the vent must be attached to the roof in a manner that prevents moisture, etc., from entering the building through the points at which the vent is secured to the roof.

Pre-existing roof vents designed for shingle roof applications are difficult to install on metal roofs and perform poorly when they are installed because they are designed to integrate with a shingle roof system. In a shingle roof system, a portion of the vent is installed underneath roofing shingles. Pre-existing adapters allow these shingle-roof vents to be installed on a metal roof, but the adapters are large and create an unsightly appearance with their expanded footprint on top of the decorative metal roof. These adapter flashings are also expensive and can drive up the cost of the project. In fact, such adapters can also cost much more than the vent itself.

Pre-existing vents designed for metal roof applications do not have a means of securely fastening the vent directly to the metal roof or the roof deck. Instead, the vents attach to a penetration through a roof, such as an exhaust vent pipe. Therefore, there is no way to securely fasten the vent over an opening in the roof deck without such penetrating members present. More specifically, preexisting vents designed for metal roofing do not attach to the structure of the roof itself. Instead, the vent is designed to attach to the protruding end of a pipe. Some vents do include a flashing made of an elastomeric material which is also fastened to the surface of the roof, but, again, the main structure of the vent is not attached to the roof surface. Because such flashings are usually made of a flexible elastomeric material, they do not provide any structure or support. It is solely used to cover the opening in the roof through which a pipe or similar penetration could pass. Due to the lack of structural stability in this design, such vents are unstable on top of a roof and can potentially even be torn away from the roof in windy conditions. Even if the vent does not detach from the roof, vents attached to a roof only by their rubber flashings will move around significantly on windy days and can be damaged over time from that movement.

SUMMARY

The present invention resolves the several problems associated with prior roof vents. The vents described herein include features that allow the more rigid main structure of the vent to be attached directly to a metal roof. Specifically, a collar of the vent is formed with feet that attach directly to a metal roof. The collar extends through the flashing, which is also attached to the metal roof Arms are provided on an upper portion of the collar, and a cap or top of the vent is attached to the arms, thereby creating a substantially rigid attachment from the cap to the metal roof attachment point. The present invention therefore provides a vent for a metal roof that attaches more securely to the roof, and is therefore more durable, while eliminating the need for special adapters to modify existing shingle roof vents for use on a metal roof. The vents described herein therefore lower installation time and cost while providing a more secure and weather resistant attachment to a roof.

DETAILED DESCRIPTION

Figure 1:
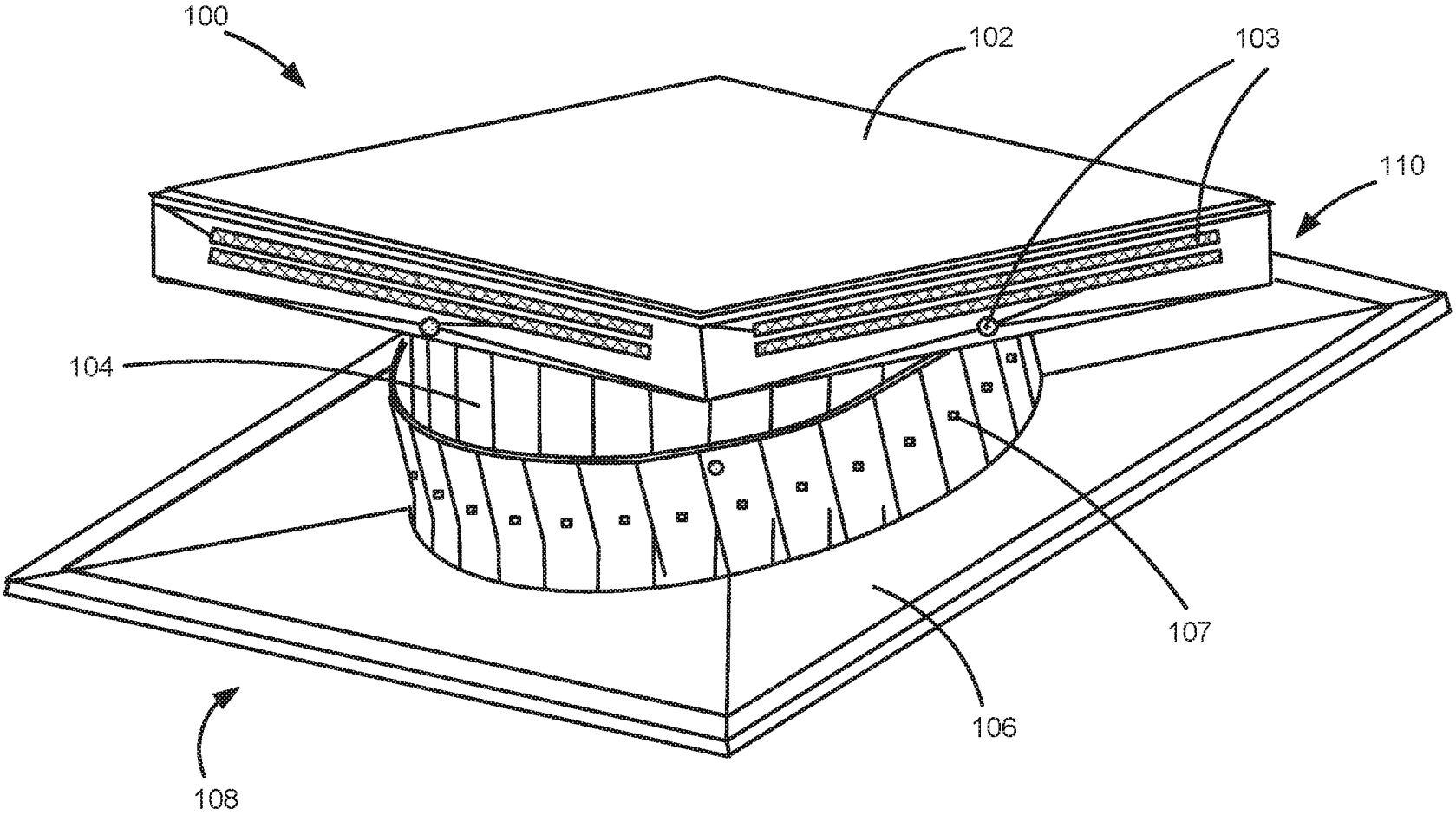
FIG. 1 is a side view of a roof vent according to the present invention.

FIG. 1 shows a vent for a roof, preferably a metal roof. Vent 100 covers openings on a metal roof and prevents moisture from entering through the opening on the metal roof. As shown in FIG. 1, vent 100 includes a cap 102 that covers the top of the vent. Cap 102 can be formed of a variety of metals or other materials. For example, cap 102 can be formed of plastic, nylon, aluminum, steel, or various other rigid materials. Slits 103 can be formed in cap 102. As described herein, slits can allow for more efficient airflow through vent 100, although primary airflow through vent 100 occurs through the bottom of cap 102 between cap 102 and collar 104. Cap 102 can also be formed without slits 103. Although slits 103 as shown in FIG. 1 are in a rectangular shape, it is understood that slits 103 can be formed in a variety of shapes, including circular, square, etc. More or fewer slits can also be used depending on desired supplemental airflow.

Underneath the cap 102 is a collar 104 that extends between the cap 102 and the neck 107 of flashing 106. Neck 107 and flashing 106 can be formed as a single unit, preferably of one piece of rubber. As shown in FIG. 1, flashing 106 is flat except for neck 107. Flashing 106 and neck 107 can be formed from an elastomeric material, for example silicone, neoprene, or ethylene propylene diene monomer (EPDM). Neck 107 can be formed of the same piece of material as flashing 106, or can be formed separately and then attached to the main body of flashing 106. Forming flashing 106 with a large generally flat section can provide a more weather-tight seal against a roof. However, flashing 106 and neck 107 can be formed of a single unit that is a cone shaped instead of having the flat flashing 106 with a neck 107 extending therefrom. That is, the entire flashing 106 could be in a general conical shape. Flashing 106 can also be formed with a larger conical section while still preserving a sufficiently sized flat portion to insure a weather-tight seal to a roof.

As will be explained in further detail with respect to other figures, vent 100 shown in FIG. 1 is designed to be attached to a pitched roof. As visible in FIG. 1, collar 104 has a first height towards the lower edge 108 of vent 100 and has a second height which is smaller than the first height towards the upper edge 110 of vent 100. This design allows cap 102 to be generally parallel relative to the ground while flashing 106 is flush against the surface of the pitched metal roof. As will be described herein in further detail, vent 100 can also be formed with a collar that has a uniform or near uniform height around its circumference. It is also understood that the height of collar 104 at lower edge 108 and upper edge 110 can be adjusted to match roofs having a variety of pitches such that, whatever the pitch of a roof, cap 102 is flat or generally flat relative to the ground. While the vents herein are described with reference to metal roofs, for which they are particularly suited, it is understood that aspects of the vents described herein can be used in shingle and flat roof applications where more secure attachment methods are desired. Moreover, the vents shown in FIGS. 1-5 show vertical lines around the perimeter of the vent collars and necks. Those lines merely represent the curvature of the collars and necks. The collars and flashing necks of the vents depicted in FIGS. 1-5 preferably have a smooth perimeter surface, such that when viewing an assembled vent there are no breaks or sharp bends. However, it is understood that it would be possible to form the curvature of the collars with a plurality of small bends instead of a smooth curvature, in which case the collar could have vertical lines as depicted in the figures. And, while the flashing necks are generally constructed from an elastomeric material, lines could be formed on the perimeter of flashing necks according to the present invention for aesthetic purposes or to add rigidity to the flashing necks.

Figure 2:
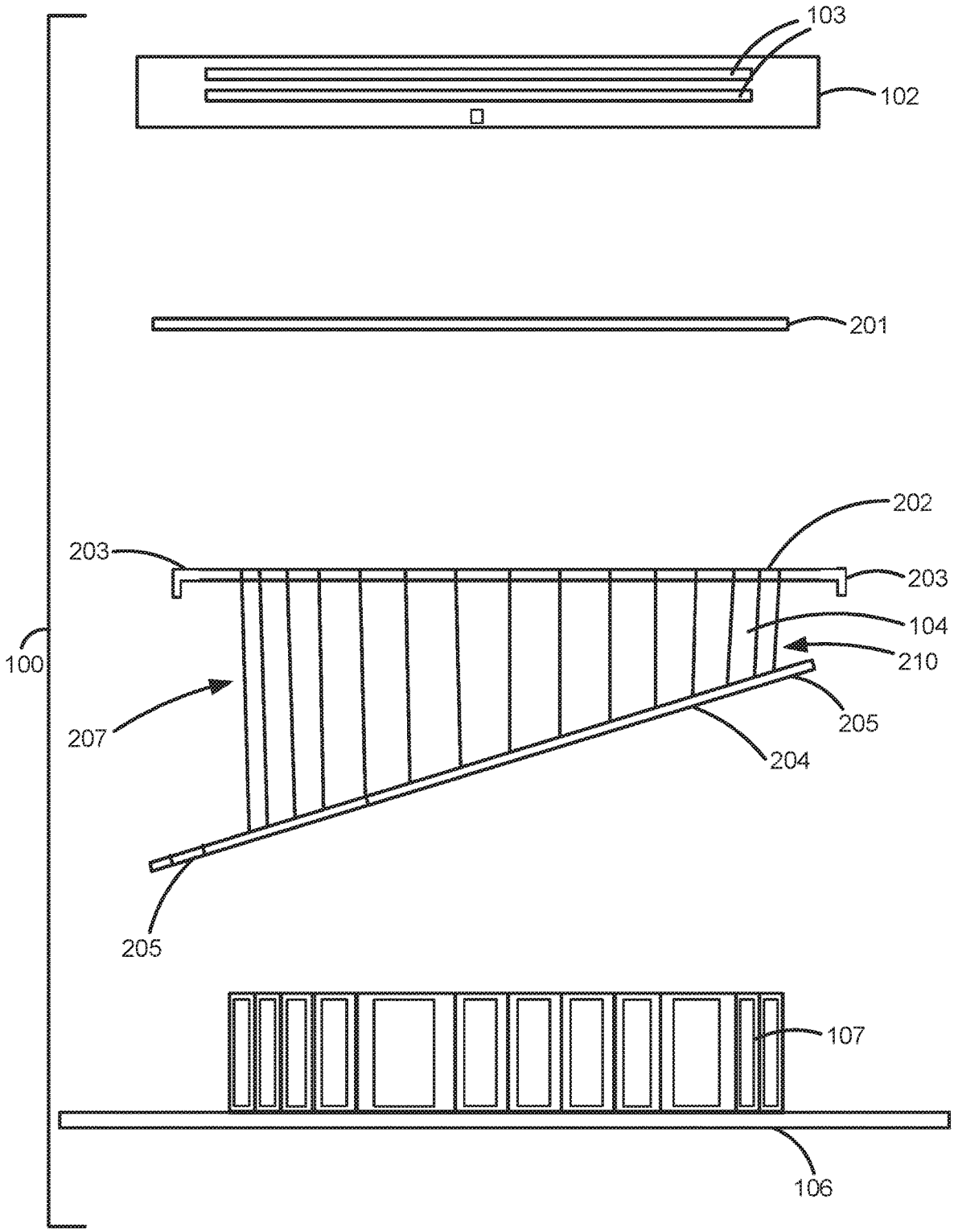
FIG. 2 is an exploded side view of the roof vent of FIG. 1.

FIG. 2 shows an exploded side view of vent 100. As with FIG. 1, FIG. 2 shows cap 102 with optional slits 103. Screen 201 is also shown in FIG. 2. Screen 201 was not shown in FIG. 1 but can be placed between cap 102 and collar 104. Screen 201 is preferably formed of a metal material such as a galvanized mesh metal. Screen 201 could also be formed of a variety of other materials that can withstand the environment of an outdoor metal roof, for example, various plastics, nylon, metals, rubbers, or fibrous materials such as fiberglass or even some plant based fibers such as rope, twine, or hemp could be used (metal screen is preferred). Screen 201 prevents animals, bugs, and other objects from entering under the cap 102 and through the collar 104, and thereby prevents those animals, bugs, and other objects from entering in the building on which the vent 100 is placed. Screen 201 can be placed flush against the top portion 202 of collar 104. Screen 201 is shown in a generally square shape, but it is understood that screen 201 could be formed in a round shape to match the outline of the top 202 of collar 104. Whether screen 201 is a square, circular, or other shape, it can extend to the end of arms 203 or can extend only around the top portion 202 of collar 204. Screen 201 could also wrap down around the outside of collar 104 to provide a secure attachment to collar 104.

Also shown in FIG. 2 is a more detailed rendering of collar 104. As shown in FIG. 2, collar 104 has a top portion 202 and a bottom portion 204. A plurality of arms 203 extend from the top portion 202 of collar 104. Because of the angle of the illustration in FIG. 2, only two arms 203 are shown, but it is understood that any number of arms could be used to achieve the goals of the invention. For example, a single large arm could be used, or more preferably three or four arms could be used to provide a solid base to which cap 102 can be attached. Collar 104 can also be formed with one or more feet 205. As with arms 203, any number of feet 205 can be formed to extend from the bottom portion 204 of collar 104. As described in more detail with respect to other figures, four feet can be formed to provide secure attachment to a metal roof around the circumference of the vent. When assembled, the feet can be configured such that each foot extends toward one of four corners of the generally rectangular or square shaped flashing. Flashing 106 can be formed in a variety of other shapes, including round, rectangular, or with multiple sides. Whatever the shape of flashing chosen, the feet 205 can be of a sufficient length to extend outward past the point where the cap 102 ends such that the feet 205 can be easily attached to the roof.

FIG. 2 also illustrates the built-in pitch of collar 104, which is designed to allow the vent 100 to be used on a pitched roof while maintaining a generally level cap 102. As seen in FIG. 2, a lower portion 207 of collar 104 has a height between the top portion 202 of collar 104 and the bottom portion 204 of collar 104 that is higher than the height between top 202 and bottom 204 of the collar 104 at an upper portion 210 of the collar 104. As described with respect to FIG. 1, this increased height at lower portion 207 of collar 104 is placed on the downslope of the roof on which vent 104 is placed. As a result, the top portion 202 of collar 104 is generally flat when compared to a ground plane, and cap 102 is also generally flat relative to the ground. Forming vent 100 such that, when installed, the cap 102 is generally parallel with a ground plane can reduce the risk of moisture from blowing into the vent while increasing airflow through the vent when compared with vents in which the cap is parallel with the roof slope after installation. The flashing 106 lays flat on the pitched metal roof to provide sufficient contact surface for weatherproofing. For a lower profile appearance, vent 100 can be formed such that cap 102 is generally parallel to the roof when vent 100 is installed.

FIG. 2 also shows flashing 106 and collar 107, which is attached to flashing 106. Flashing 106 and neck 107 can be formed of the same material as one unit. Flashing 106 and neck 107 can also be formed in a conical shape instead of having a flat base with a neck extending therefrom, as shown in FIG. 2. Flashing 106 and neck 107 can be formed of an elastomeric material such as silicone rubber, EPDM, or any other substance with similar properties.

Figure 3:
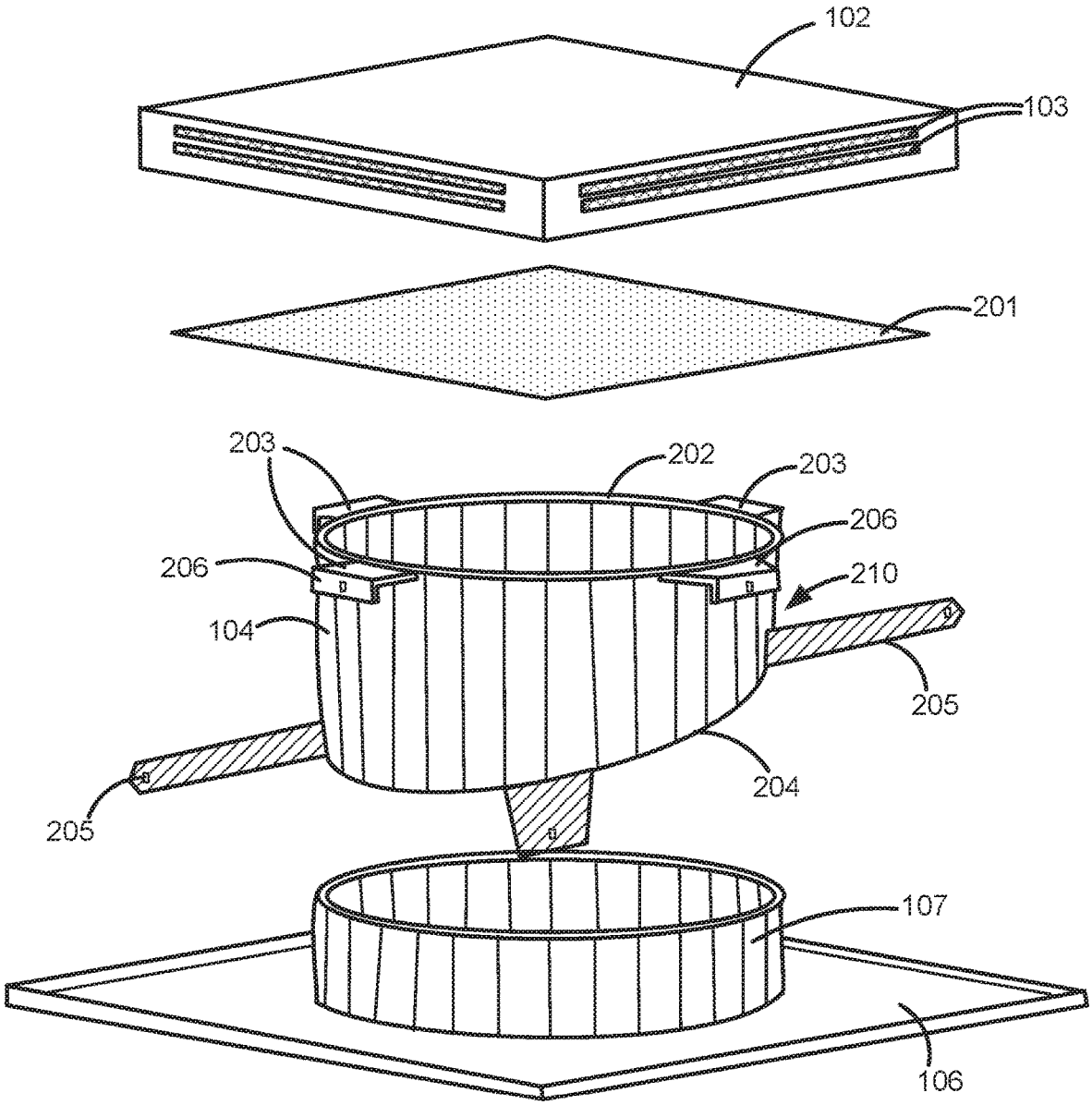
FIG. 3 is an exploded top view of the roof vent of FIG. 1.

FIG. 3 illustrates an exploded top perspective view of vent 100. As can be seen in FIG. 3, vent 100 includes all components referred to in FIG. 1 and FIG. 2. FIG. 3 shows vent 100 with four arms 203. Each arm 203 includes a protrusion 206 extending down at approximately a right angle towards flashing 106, while these protrusions 206 are shown at a right angle it is understood that other angles can be used. Protrusions 206 allow cap 102 to be secured to the protrusions 206 while the under-surface of the cap 102 is spaced above the top portion 202 of collar 104. Spacing the under-surface of cap 102 above the top portion 202 of collar 104 allows air to exit the vent between the cap and the collar. As discussed previously, screen 201 prevents debris, small animals, and bugs from accessing the opening in the top portion 202 of collar 104. Feet 205 of collar 104 are designed to attach directly to a metal roof or to the roof deck if the metal roof panel has been cut away.

Flashing 106 and neck 107, which can be formed of a rubber material, are stretchable. During assembly, feet 205 are placed through neck 107 and under flashing 106. Neck 107 of flashing 106 rests securely around the circumference of collar 104. The entire vent assembly 100 can then be attached to the metal roof simply by attaching feet 205 to the roof. The cap and screen are secured to the collar 104, and the feet 205 of collar 104 are secured to the roof. Neck 107 of flashing 106 is held in place by chemical bonding against collar 104. Silicone caulk, liquid rubber, or other similar substances can also be used around the edges of flashing 106 to provide additional attachment strength and weatherproofing. Vent 100 can be preassembled, sold, and delivered to customers in the form shown in FIG. 1. To attach vent 100 to a metal roof, the feet 205, which have already been placed fully through neck 107 such that they are underneath flashing 106 while collar 104 protrudes from neck 107, are attached directly to the metal roof or roof deck. After attaching feet 205 to metal roof or roof deck, the flashing 106 can be brought down to cover the feet 205 and fastened to the metal roof by means of screws penetrating the flashing through a reinforcement material around the outer perimeter of the flashing 106. Although not shown in the figures, the reinforcement material can be a rigid or semi-rigid material, such as a metal or rigid or semi-rigid plastic. The reinforcement material assists in keeping flashing flat against the roof as it can be formed to match the contours of a metal roof panel.

Figure 4:
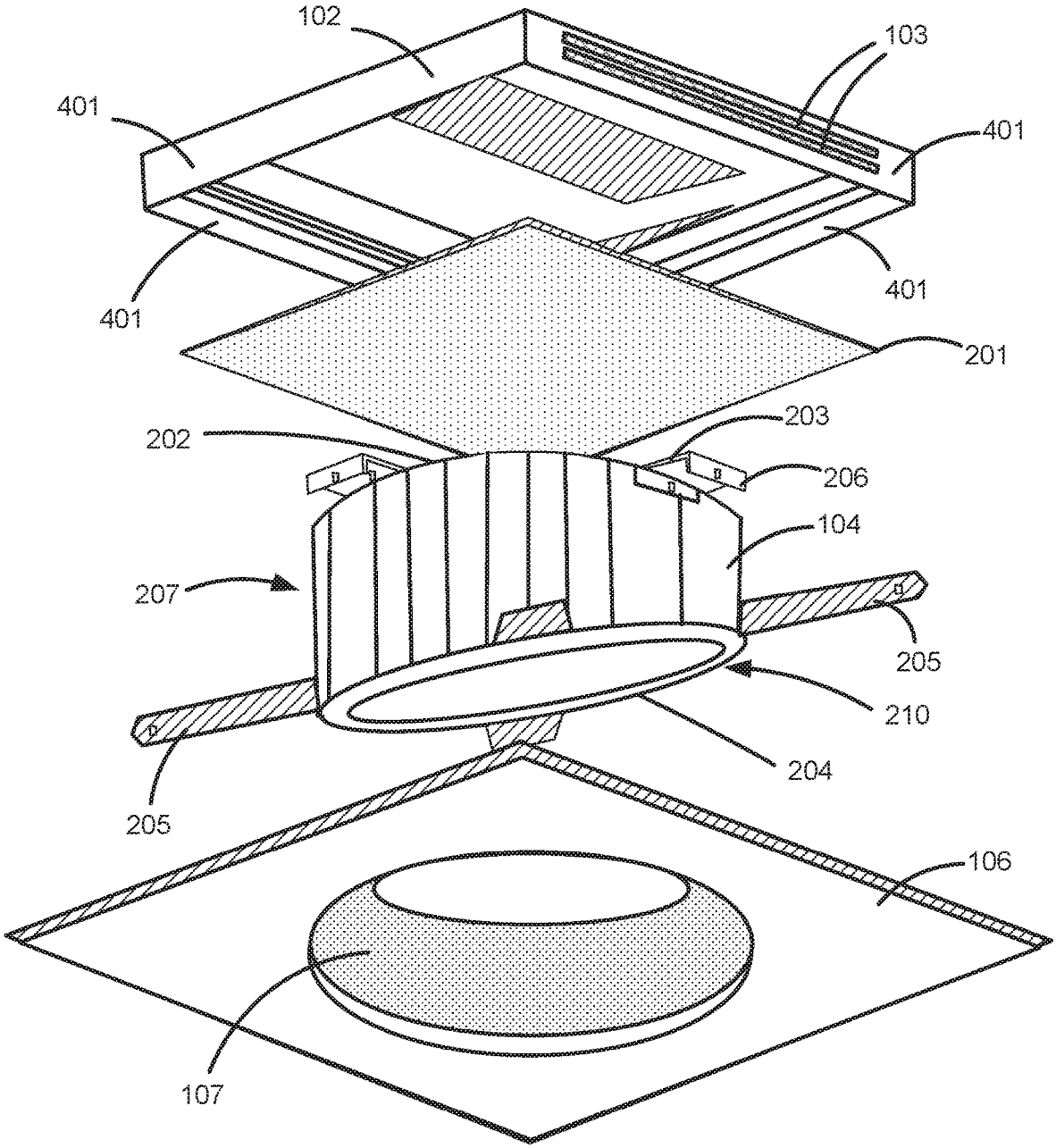
FIG. 4 is an exploded bottom view of the roof vent of FIG. 1.

FIG. 4 is a bottom exploded perspective view of vent 100. As can be seen in FIG. 4, cap 102 includes lips 401. The lips 401 fit over protrusions 206 of arms 203 and are attached thereto. Also, as seen in FIG. 4, collar 104 includes four feet 205, although as described herein fewer or more feet could be used to secure the vent 100 to a roof.

Figure 5:
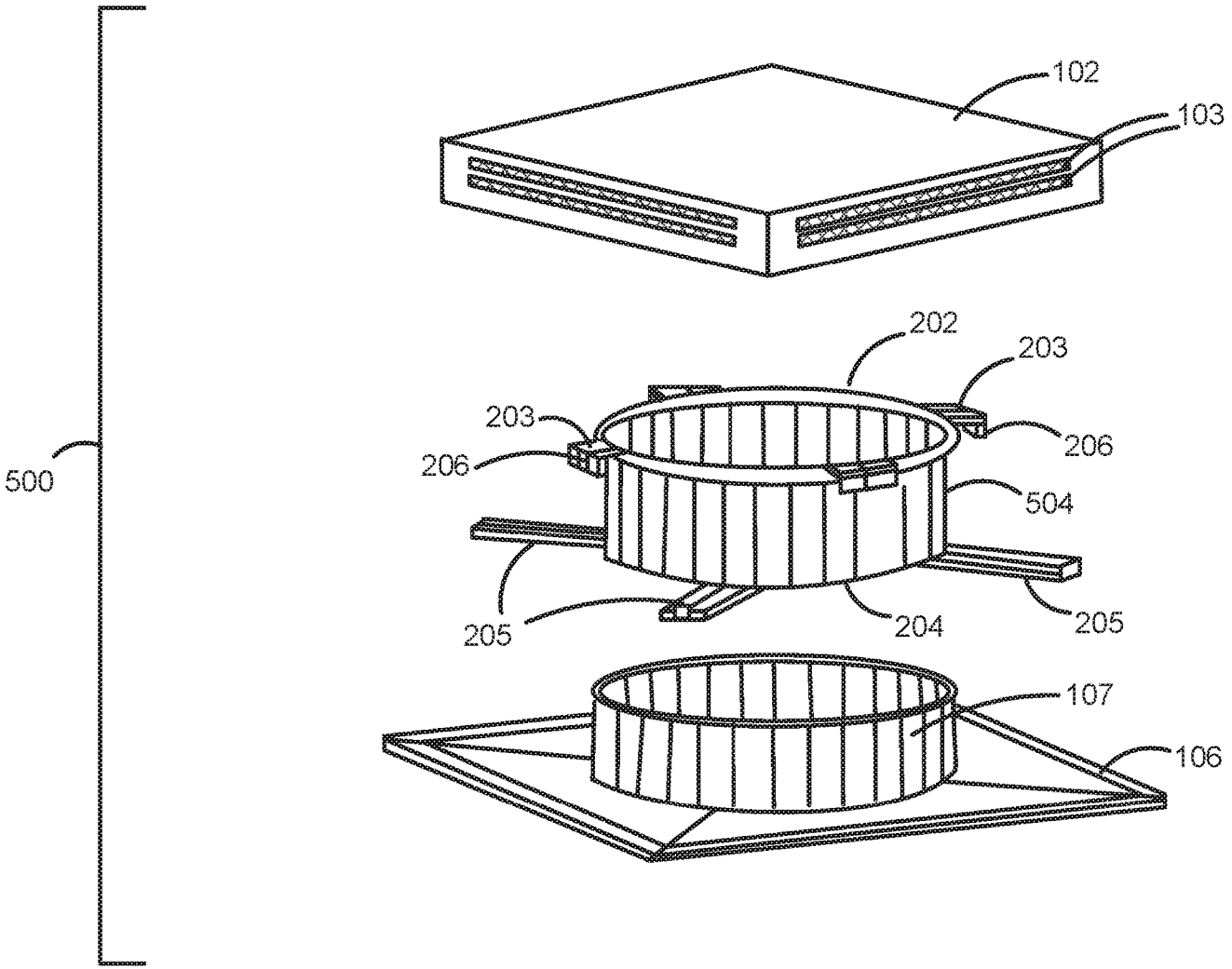
FIG. 5 is a is an exploded side view of another roof vent according to the present invention.
Figure 6:
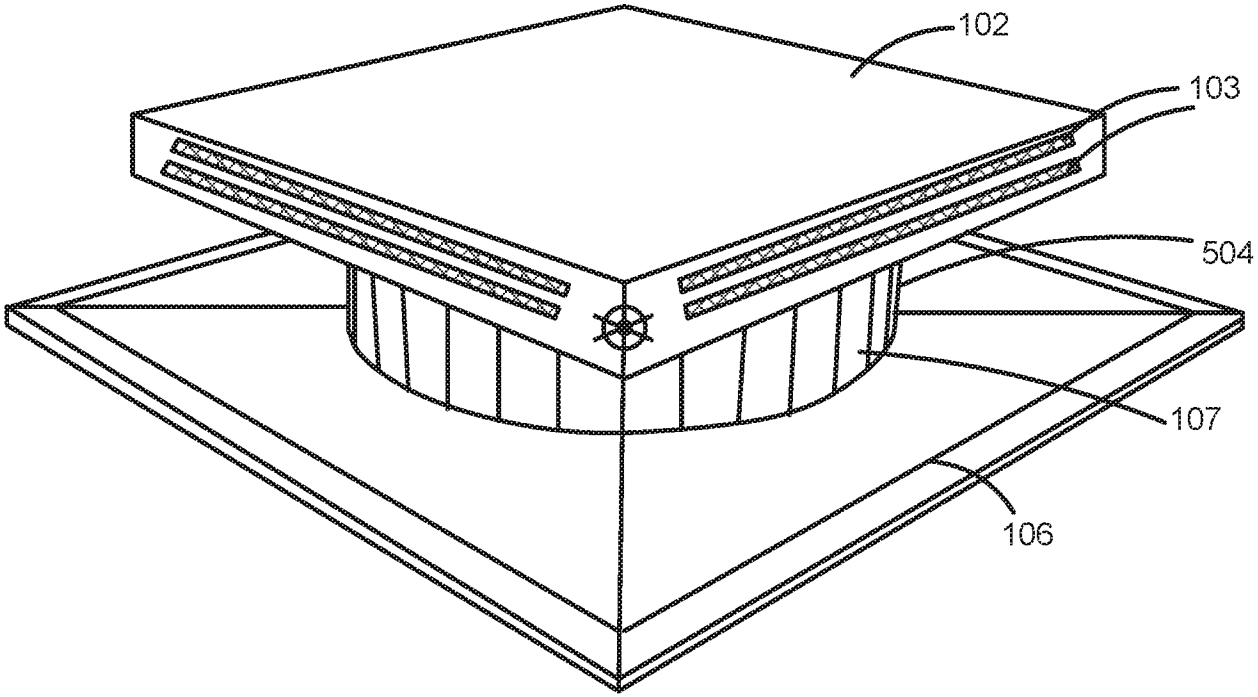
FIG. 6 is a side view of the roof vent of FIG. 5, fully assembled.

FIG. 5 shows a roof vent 500 that is designed to have a low profile which is situated approximately parallel to the plane of the roof no matter the pitch. Roof vent 500 is largely identical to roof vent 100 as described with respect to FIGS. 1-4, except that the collar 504 for roof vent 500 has a uniform or generally uniform height around its circumference. As a result, as shown in FIG. 6, when roof vent 500 is attached to a flat roof, cap 102 is generally parallel to the surface of the metal roof. While not shown in FIG. 5, vent 500 can also be provided with a screen as shows in FIGS. 2-4.

Systems, methods and apparatus are provided herein. References to "preferred embodiments," "another embodiment," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments, whether or not explicitly described. After reading the description, it will be apparent to one skilled in the relevant art how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A roof vent for attachment to a metal roof, comprising:

a cap;

a collar with a top portion and a bottom portion, wherein the collar forms a perimeter with an opening therethrough defining an interior wall of the collar and exterior wall of the collar, wherein the collar has a plurality of arms extending outwardly from the top portion thereof, wherein the arms are attached to the cap, and wherein the collar includes a plurality of feet along the bottom portion thereof extending outwardly from the exterior wall of the collar; and a flashing, wherein the flashing includes a neck attached to the exterior wall of the collar, wherein the feet of the collar are configured to attach to a roof such that the feet of the collar are positioned underneath the neck of the flashing when the roof vent is installed on a roof.

2. The roof vent of claim 1, wherein the collar has a down-roof side and an up-roof side, wherein the down-roof side is configured to be positioned lower on a pitched roof than the up-roof side, and wherein the down-roof side has a first height and the up-roof side has a second height, and wherein the first height is larger than the second height.

3. The roof vent of claim 2, wherein, when installed, the cap is generally parallel to a ground plane.

4. The roof vent of claim 2, wherein the collar includes four feet.

5. The roof vent of claim 1, wherein the feet extend horizontally farther than the cap to facilitate attachment of the feet to the roof.

6. The roof vent of claim 1, wherein the arms include a protrusion extending downwardly from the arm towards the bottom portion of the collar.

7. The roof vent of claim 6, wherein the collar includes four arms.

8. The roof vent of claim 1, wherein the cap and collar are formed from a metal material and the flashing is formed from an elastomeric material.

9. The roof vent of claim 8, wherein the flashing includes a reinforcement material.

10. The roof vent of claim 1, wherein, when installed, the cap is generally parallel to the roof.

11. A method of assembling and installing a roof vent, comprising:

attaching a cap to a collar, wherein the collar has a top portion and a bottom portion, wherein the collar forms a perimeter with an opening therethrough defining an interior wall of the collar and exterior wall of the collar, wherein the collar has a plurality of arms extending outwardly from the top portion thereof, wherein the arms are attached to the cap, and wherein the collar includes a plurality of feet along the bottom portion thereof extending outwardly from the exterior wall of the collar;

attaching a flashing to the collar, wherein the flashing includes a neck attached to the exterior wall of the collar; and attaching the feet of the collar to a roof such that the feet of the collar are positioned underneath the neck of the flashing when the roof vent is installed on a roof.

12. The method of assembling and installing a roof vent of claim 11, wherein the collar has a down-roof side and an up-roof side, wherein the down-roof side is configured to be positioned lower on a pitched roof than the up-roof side, and wherein the down-roof side has a first height and the up-roof side has a second height, and wherein the first height is larger than the second height.

13. The method of assembling and installing a roof vent of claim 12, wherein, when installed, the cap is generally parallel to a ground plane.

14. The method of assembling and installing a roof vent of claim 12, wherein the collar includes four feet.

15. The method of assembling and installing a roof vent of claim 11, wherein the feet of the collar are configured to attach to a metal roof, wherein the flashing is generally rectangular and includes four corners, and wherein each of the feet extends towards one of the four corners.

16. The method of assembling and installing a roof vent of claim 11, wherein the feet extend horizontally farther than the cap to facilitate attachment of the feet to the roof.

17. The method of assembling and installing a roof vent of claim 16, wherein the collar includes four arms.

18. The method of assembling and installing a roof vent of claim 11, wherein the cap and collar are formed from a metal material and the flashing is formed from an elastomeric material.

19. The method of assembling and installing a roof vent of claim 18, wherein the flashing includes a reinforcement material.

20. The method of assembling and installing a roof vent of claim 11, wherein, when installed, the cap is generally parallel to the roof.

* * * * *